United States Patent [19]

Wiedemann et al.

[11] 3,937,770

[45] Feb. 10, 1976

[54] METHOD FOR THE PRODUCTION OF MEALY CRUDE BLACK POWDER WHICH CAN BE FURTHER PROCESSED

[75] Inventors: Wolfgang Wiedemann, Dulmen; Friedrich Platte, Recklinghausen, both of Germany

[73] Assignee: Wasagchemie GmbH, Munich, Germany

[22] Filed: Oct. 3, 1973

[21] Appl. No.: 403,200

[30] Foreign Application Priority Data

Oct. 17, 1972 Germany ..... 2250823

[52] U.S. Cl. ..... 264/3 C; 149/72

[51] Int. Cl.[2] ..... C06B 21/00

[58] Field of Search ..... 149/72; 264/3 C

[56] References Cited

UNITED STATES PATENTS 3,660,546 5/1972 Lovold ..... 264/3 C

*Primary Examiner*—Stephen J. Lechert, Jr.

*Attorney, Agent, or Firm*—Hammond and Littell

[57] ABSTRACT

A method for the production of mealy crude black powder from components consisting essentially of potassium nitrate, sulfur and carbon, all in particle form, comprises the steps of placing each component in a storage container, continuously withdrawing said components individually from said storage containers in the determined proportions, continuously feeding said separate components as particles into a circular oscillating cylindrical grinding zone consisting of at least two grinding zones rigidly interconnected and containing grinding elements, whereby said component particles are ground and mixed with each other with agglomeration of the individual component particles, and continuously withdrawing said mealy crude black powder. This mealy crude black powder is then compressed and granulated, followed optionally by further treatment such as polishing and graphitizing or grinding.

8 Claims, 1 Drawing Figure

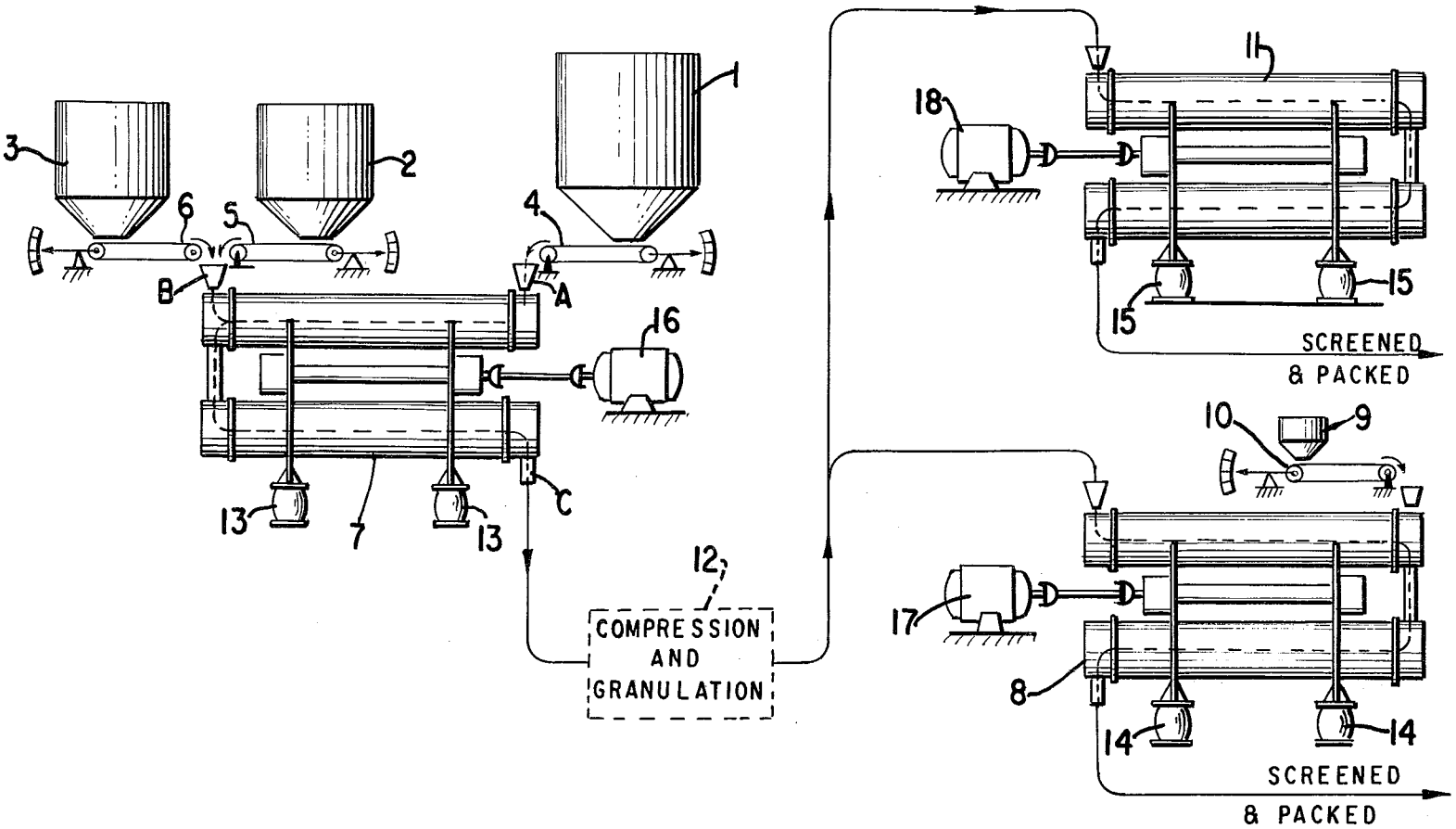
SCREENED & PACKED
SCREENED & PACKED
COMPRESSION AND GRANULATION
1
2
3
4
5
6
7
8
9
10
11
12
13
14
15
16
17
18
A
B
C

METHOD FOR THE PRODUCTION OF MEALY CRUDE BLACK POWDER WHICH CAN BE FURTHER PROCESSED

THE PRIOR ART

The method for the production of black powder usually comprises the grinding of the three components $KNO_3$, carbon and sulfur, mixing and agglomerating them, compressing the material thus obtained to a density of about 1.75 gm/cm$^3$, as well as subsequent granulation and polishing. Originally the processes which included the steps of grinding, mixing, agglomerating, and compressing were carried out in mechanically operated stamping devices (Urbanski, Chemie und Technologie der Explosivstoffe, vol. III, Leipzig 1964, p. 369). Later the three components were ground separately; or for safety reasons two components were ground at one time, for example, $KNO_3$ and sulfur or carbon and sulfur. Then the final mixing and agglomeration of the constituents of the black powder were effected in ball mills and edge mills, using in some cases the ball mill first as a premixing stage and then the edge mill. With the possibility of obtaining sulfur and carbon in a finely ground form, the method for the production of mealy crude black powder has beem simplified in many cases, since only $KNO_3$ must be ground, and sulfur and carbon must be mixed as a binary batch. These two black powder portions thus obtained are fed jointly to the edge mill and mixed there thoroughly, while the three components are further ground and agglomerated, and the material is compressed.

There have been many attempts to replace this cumbersome process of the mixing and agglomeration by other methods. U.S. Pat. No. 1,017,286 suggests kneading a mixture of a solution of one or several components of black powder with the remaining components, with simultaneous evaporation of the solvent, and then extruding the mealy crude black powder thus produced as a rolled strip. Belgian Pat. No. 705,475 describes a method in which the work of the edge mill is taken over by several pairs of rolls. The material charged into the center forms a coating on a roll of the first pair of rolls, which coating is displaced in both axial directions under kneading by additional centrally supplied material. After the coating has been formed on the entire width of the roll, it is peeled off and fed over a conveyer means to another pair of rolls working in the same manner. This process is repeated until the desired results are obtained.

According to German Auslegeschrift No. 2,005,549 the components $KNO_3$, carbon and sulfur are first roughly mixed with each other, and then further mixed and ground in an air jet mill with simultaneous agglomeration. The polishing and graphitizing, usually carried out after the subsequent intermediate processes of compression and granulation, is effected in polishing drums holding charges of about 300 kg of granulated black powder. In order to obtain better results an operating time of several hours is required (Urbanski, l.c. p. 378). Graphitized black powder requires an additional processing time. Mealy powder from the granulated preliminary product is produced by grinding black powder in wooden drums covered with screens and filled with grinding elements.

The use of mechanically driven stamping device expectedly resulted in very low productivity; in addition, the method was dangerous because of the possible reactions of sulfur with the ambient air. The methods used later by the prior art have the disadvantage that continuous production is not possible with the use of ball mills and edge mills. In order to achieve a slightly more economical production, charges of 100 kg must be introduced into the edge mill which represent, however, a large enough accumulation of material to constitute an increased hazard. Another disadvantage is the fact that lengthy processing times with the above mentioned devices are necessary to achieve the desired effect; and a greater number of equipment parts must be provided, accommodated and operated. The above mentioned method of mixing a solution of one or more components with the remaining components requires a considerable number of devices for the production of the solution and drying after the final kneading process. The method of kneading between pairs of rolls requires considerable space, since the desired kneading effect is only achieved by arranging a sufficient number of these parts of the apparatus in series. The production of mealy crude black powder by means of an air jet mill requires a considerable amount of compressed air and thus consumes considerable energy. In addition, the material leaving the jet mill is mixed to a considerable extent with air, due to the close contact between the grinding air and the material to be ground, which renders the compression of the mealy crude black powder more difficult. The separation of the mealy crude black powder from the air requires separating and filter means which are costly and occupy large areas of plant space. The usual arrangements following the processes of compression and granulation likewise require that charges of about 300 kg be processed, which again leads to a large accumulation of crude black powder which constitutes a hazard. Here again it is not possible to have an economical continuous operation without personnel who would be exposed to this hazard.

OBJECTS OF THE INVENTION

It is an object of the invention therefore to permit a more economical production of mealy crude black powder, compared to conventional methods, and its subsequent further treatment, and to permit the production in continuous operations at a minimum of expense, with minimum personnel requirement and in a production area where no personnel is present, and with maximum safety.

It is another object of the present invention to provide a method for the production of mealy crude black powder from components consisting essentially of potassium nitrate, sulfur and carbon all in particle form comprising the steps of placing each component in a storage container, continuously withdrawing said components individually from said storage containers in the determined proportions, continuously feeding said separate components as particles into a circular oscillating cylindrical grinding zone consisting of at least two grinding zones rigidly interconnected and containing grinding elements, whereby said component particles are ground and mixed with each other with agglomeration of the individual component particles, and continuously withdrawing said mealy crude black powder.

A yet further object of the invention is the further processing of the above mealy crude black powder to obtain a commercial product.

These and other objects of the present invention will become apparent as the description thereof proceeds.

THE DRAWING

The FIGURE is a schematic flow diagram of the operation of the process of the invention.

DESCRIPTION OF THE INVENTION

The present invention provides a solution to the above-identified problem in which the components are withdrawn individually from their storage bins in the corresponding quantities and are fed to a tubular swing mill consisting of several rigidly connected grinding tubes mounted on rubber buffers and containing grinding elements, and which are set in circular oscillations by means of an eccentric drive, and ground and mixed until the individual particles are agglomerated. Due to these oscillations, a spiral path of the charged material through the series-connected grinding tubes is created opposite to the driving direction. The residence time required for the desired fineness of grinding, which depends on the amount of the charge, results, in addition to the grinding effect, also in an intensive mixing, kneading and "interlaced grinding" by grinding of the components with simultaneous preliminary compression, which is similar to the edge mill.

The present invention further provides a method for the production of mealy crude black powder from components consisting essentially of potassium nitrate, sulfur and carbon all in particle form comprising the steps of placing each component in a storage container, continuously withdrawing said components individually from said storage containers in the determined proportions, continuously feeding said separate components as particles into a circular oscillating cylindrical grinding zone consisting of at least two grinding zones rigidly interconnected and containing grinding elements, whereby said component particles are ground and mixed with each other with agglomeration of the individual component particles, and continuously withdrawing said mealy crude black powder.

According to a preferred embodiment of the invention, the potassium nitrate passes through a pregrinding zone within the tubular swing mill, preferably in a grain size of 0.1 to 0.5 mm, before the other components are added.

The danger of electrostatic ignition of the sulfur is reduced by the presence of $KNO_3$. This danger is further reduced if air of high relative humidity, preferably 70% to 90%, is blown through the self-contained system of the tubular swing mill according to another embodiment of the invention.

The invention also relates to the further treatment of the mealy crude black powder after subsequent compression and granulation, in which the granulated black powder is fed into a tubular swing mill of the above described type but without containing any grinding elements, and is polished therein. Due to the circular oscillations of the mill, an oppositely directed spiral path is imparted to the granulated material, which results in a constant friction among the grains which causes the rounding of the sharp edges thereof, after a prolonged residence time.

If graphitization of the granulated black powder is required, this is effected after the polishing in the initial or polishing zone of the mill, in the subsequent graphitizing zone of the tubular swing mill. To this end graphite is charged into the graphitizing zone through a metering device.

Finally the invention also concerns the production of so-called "meal powder" from the above described material, by feeding the compressed and granulated black powder to a tubular swing mill, as it is used for the production of mealy crude black powder, and grinding it to meal powder.

The present invention has the advantages that, when compared to the known methods, an automatic continuous operation without the presence of personnel in the working area is made possible, while the energy and space requirements are reduced at the same time. The mealy crude black powder obtained has pressing properties as good as the material obtained by means of the older methods. Furthermore the crude black powder has a very uniform particle size of small spherical particles which pack down to a high density.

The following examples are merely illustrative of the present invention without being deemed limitative in any manner thereof.

EXAMPLE 1

In order to show the economical advantages of the invention, Table 1 below contains the energy requirements of prior art methods compared to the present invention.

TABLE 1

| Method of operation used | Electric power consumption per 100 kg of mealy black powder, in kwh |
|---|---|
| Edge mill | 18 |
| Air Jet mill | 45 |
| Tubular swing mill | 9 |

A greater economy is also achieved in polishing, graphitizing and in the production of meal powder, compared with the conventional methods, because in this case too, considerable savings in personnel and space are made possible by the continuous operation.

EXAMPLE 2

In carrying out the method of producing mealy crude black powder from its components namely potassium nitrate, sulfur and carbon, a tubular swing mill device is utilized. This device is indicated as 7, 8 or 11 in the FIGURE and comprises at least two horizontal grinding tubes rigidly connected with each other which are mounted on rubber baffles 13, 14 or 15, respectively. If the tubular swing mill is to grind the powder components such as in device 7, or to grind the powder to meal powder such as in device 11, then grinding elements such as spherical stone or steel balls are contained therein. If the tubular swing mill is to polish the crude black powder such as in device 8, then grinding elements are absent from this device. The tubes are set into circular oscillatory motion by an eccentric drive means coupled respectively with motor means 16, 17 or 18. In device 7 the component particles of black powder are then ground and mixed with each other until the individual particles are agglomerated.

Intermediate apparatus 12 is of known construction as disclosed in copending U.S. patent applications Ser. No. 274,493 filed July 24, 1972 and Ser. No. 281,622 filed Aug. 18, 1972.

U.S. Ser. No. 274,493 discloses the densification and compression of black powder, while U.S. Ser. No. 281,622 discloses the granulation of black powder.

Crude black powder of the composition 75% $KNO_3$, 10% sulfur and 15% carbon was produced, for example, with an output of 2 tons per shift. The $KNO_3$ storage container 1 was filled at the start of the shift with 1500 kg of potassium nitrate of 0.1 to 0.5 mm grain size, while the sulfur storage container 2 was filled with 200 kg sulfur, very finely ground, and the carbon storage container 3 was filled with 300 kg charcoal, very finely ground. $KNO_3$ with a coarse grain was used because the metering becomes more difficult as the grain size decreases. $KNO_3$ was fed to the tubular swing mill 7 which serves to grind, mix and agglomerate the components of black powder, through inlet A from the metering device conveyor belt 4 at the rate of 3.33 kg/min. The potassium nitrate is preground in the upper tube of the mill 7. Through inlet B of the tubular swing mill 7 the finely ground sulfur component was added at the rate of 0.44 kg/min from the metering device conveyor belt 5, and carbon component was added at the rate of 0.66 kg/min from the metering device conveyor belt 6. In other embodiments other feedings points can be selected. In a further embodiment all three components can be charged jointly at one point. In the bottom tube of tubular swing mill 7 the joint grinding and mixing of the components takes place as well as the agglomeration of the particles. Through the outlet C of the tubular swing mill 7 issues the finished mealy crude black powder which can be fed to the following intermediate apparatus 12 which compresses and granulates the finished crude black powder, as described in U.S. Ser. No. 274,493 and U.S. Ser. No. 281,622, respectively.

The granulated black powder was either charged into the tubular swing mill 8 in which it is polished in the upper tube and after passing through the upper tube, mixed if necessary at the outlet end of the upper tube, with graphite from container 9 from metering device conveyor belt 10 and coated completely in the bottom tube.

In a further embodiment the granulated black powder was charged into the tubular swing mill 11 to be ground into meal powder, after having been discharged from the intermediate apparatus 12. After having been processed through the tubular swing mills 8 or 11, the formed black powder can be subjected to further processing, such as finishing, and after screening or dust removal, it can be packaged.

As a yet further embodiment of the present invention, the black powder from apparatus 12 may be divided into two portions and simultaneously fed into tubular swing mills 8 and 11.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

We claim:

1. A method for the production of mealy crude black powder from components consisting essentially of potassium nitrate, sulfur and carbon all in particle form comprising the steps of placing each component in a storage container, continuously withdrawing said components individually from said storage containers in the determined proportions, continuously feeding said separate components as particles into a circular oscillating cylindrical grinding zone consisting of at least two grinding zones rigidly interconnected and containing grinding elements, whereby said component particles are ground and mixed with each other with agglomeration of the individual component particles, and continuously withdrawing said mealy crude black powder.

2. The method of claim 1 wherein said circular oscillating cylindrical grinding zone is a tubular swing mill consisting of several grinding tubes rigidly interconnected, said mill being mounted on flexible supports, containing grinding elements in said grinding tubes, and being set into circular oscillation by means of an eccentric drive.

3. The method of claim 1, which comprises passing the potassium nitrate with a grain size of 0.1 to 0.5 mm through a pregrinding zone in said circular oscillating cylindrical grinding zone before said other components are introduced.

4. The method of claim 1 which comprises passing air of high relative humidity through said circular oscillating cylindrical grinding zone which is a self-contained system.

5. The method of claim 4 in which said air is of 70% to 90% relative humidity.

6. A method for the finishing of mealy crude black powder, prepared according to the method of claim 1, comprising continuously compressing and granulating said powder in compression and granulation zones, and then continuously feeding said granulated powder to a circular oscillating cylindrical polishing zone devoid of grinding elements, whereby said granulated black powder is polished.

7. The method of claim 6, which further comprises, after polishing said black powder in said polishing zone, continuously feeding said polished black powder into a circular oscillating cylindrical graphitizing zone, whereby said powder is graphitized.

8. A method for the finishing of mealy crude black powder, prepared according to the method of claim 1, comprising continuously compressing and granulating said powder in compression and granulation zones, and then continuously feeding said granulated powder to a circular oscillating cylindrical grinding zone consisting of at least two grinding zones rigidly interconnected and containing grinding elements, whereby said granulated powder is ground into meal powder.

* * * * *